US011148462B2

(12) United States Patent
Cauwels et al.

(10) Patent No.: US 11,148,462 B2
(45) Date of Patent: Oct. 19, 2021

(54) RETRACTABLE NOSECONE WRITING INSTRUMENT

(71) Applicant: Sanford, L.P., Atlanta, GA (US)

(72) Inventors: Kyle Cauwels, Bloomingdale, IL (US); David Moraski, Naperville, IL (US); James Bergman, Sugar Grove, IL (US)

(73) Assignee: SANFORD, L.P., Atlanta, GA (US)

( * ) Notice: Subject to any disclaimer, the term of this patent is extended or adjusted under 35 U.S.C. 154(b) by 0 days.

(21) Appl. No.: 16/648,444

(22) PCT Filed: Sep. 26, 2018

(86) PCT No.: PCT/US2018/052951
§ 371 (c)(1),
(2) Date: Mar. 18, 2020

(87) PCT Pub. No.: WO2019/067612
PCT Pub. Date: Apr. 4, 2019

(65) Prior Publication Data

US 2020/0223246 A1 Jul. 16, 2020

Related U.S. Application Data

(60) Provisional application No. 62/564,653, filed on Sep. 28, 2017.

(51) Int. Cl.
*B43K 24/04* (2006.01)
*B43K 7/00* (2006.01)
(Continued)

(52) U.S. Cl.
CPC ..... *B43K 24/04* (2013.01); *B43K 7/005* (2013.01); *B43K 5/005* (2013.01); *B43K 8/003* (2013.01); *B43K 24/026* (2013.01)

(58) Field of Classification Search
CPC ..... B43K 24/04; B43K 7/005; B43K 5/005; B43K 5/16; B43K 8/003; B43K 21/006;
(Continued)

(56) References Cited

U.S. PATENT DOCUMENTS 2,941,511 A 6/1960 Cieremans
4,025,204 A 5/1977 Hobbs
(Continued)

FOREIGN PATENT DOCUMENTS

EP 0 402 558 A1 12/1990
KR 2000 0018624 10/2000

OTHER PUBLICATIONS

International Search Report and Written Opinion for International Application No. PCT/US2018/052951 dated Jan. 11, 2019 (10 pages).

(Continued)

*Primary Examiner* — David J Walczak
(74) *Attorney, Agent, or Firm* — Eversheds Sutherland (US) LLP

(57) ABSTRACT

The writing instrument includes a body, a nosecone, and an adapter. The body, nosecone, and adapter each include a generally hollow tubular shape and an inner surface, outer surface, first end, and second end. The first end of the adapter is coupled to the second end of the nosecone. The second end of the adapter is configured to slidably couple to the first end of the body. The writing instrument includes a writing element with a mounting end and a writing end. The mounting end of the writing element is removably coupled to a second end of the body. The adapter includes a track and the track includes a recessed channel in the outer surface of the adapter. The body includes at least one protrusion that extends inwards from the inner surface of the body. The protrusion slidably engages with the track of the adapter.

15 Claims, 11 Drawing Sheets

(51) Int. Cl.

| | |
|---|---|
| ***B43K 5/00*** | (2006.01) |
| ***B43K 8/00*** | (2006.01) |
| ***B43K 24/06*** | (2006.01) |
| *B43K 24/02* | (2006.01) |

(58) Field of Classification Search
CPC ..... B43K 24/026; B43K 24/00; B43K 24/02; B43K 24/06
USPC ..... 401/107, 108, 117
See application file for complete search history.

(56) References Cited

U.S. PATENT DOCUMENTS

| | | | | |
|---|---|---|---|---|
| 4,780,016 | A * | 10/1988 | Kim | B43K 23/10 401/116 |
| 8,079,767 | B2 * | 12/2011 | Rolion | B43K 23/12 401/107 |
| 9,539,848 | B2 * | 1/2017 | Bez | B43K 24/026 |
| 2010/0074670 | A1 | 3/2010 | Rolion | |
| 2011/0129285 | A1 * | 6/2011 | Liu | B43K 7/12 401/117 |
| 2012/0163896 | A1 * | 6/2012 | Zhao | B43K 23/12 401/117 |
| 2014/0376987 | A1 | 12/2014 | Rolion et al. | |
| 2015/0043957 | A1 | 2/2015 | Bez | |

OTHER PUBLICATIONS

Extended European Search Report for Application No. 18862292.2 dated Apr. 7, 2021 (7 pages).

* cited by examiner

RETRACTABLE NOSECONE WRITING INSTRUMENT

CROSS-REFERENCE TO RELATED APPLICATIONS

This application is a U.S. national stage application of International Application No. PCT/US2018/052951, filed Sep. 26, 2018, which claims priority benefit of U.S. Provisional Patent Application No. 62/564,653, filed on Sep. 28, 2017, the disclosures of which are incorporated by reference herein in their entirety.

TECHNICAL FIELD

This disclosure generally relates to writing instruments, and more specifically, to writing instruments having a retractable nosecone.

BACKGROUND

Writing instruments, and specifically pens, have been in widespread use for hundreds of years, with the modern ballpoint pen dating to the 1940s. Pens are typically writing instruments with an internal ink reservoir that dispenses ink on a writing surface as the pen makes contact with a substrate. Pens use various dispensing designs and inks to create a controlled ink output that does not leak ink when the pen is not in use. Ballpoint pens are commonly used, combining the internal reservoir with a dispensing tip that includes a roller ball to control the flow of ink.

To further prevent the inadvertent dispensing of ink, pens routinely come with a cap or cover to protect the dispensing tip and prevent inadvertent activation of the roller ball. Alternatively, some pens utilize a retractable tip that withdraws the dispensing tip into the body of the pen when the pen is not in use. While mechanically more complex, retractable pens have the benefit of single-piece construction which means there is no cap to lose, potentially leaving the pen more susceptible to inadvertent ink dispensing. Retractable pens also offer the possibility of single-handed use, allowing for one handed activation, use, and retraction of the pen in a wide variety of circumstances. Various configurations have been utilized throughout the years, offering differing complexities in terms of use and the mechanisms controlling the operation of the pen. By utilizing different retraction mechanisms, manufacturers can change the ergonomics of the pen, impact the manufacturing complexity and cost, and improve the reliability of the pen.

Accordingly, a need exists to create a simple, reliable, retractable pen that overcomes the one or more of the disadvantages of current designs and allow for the simple one-handed operation of the pen.

SUMMARY

In one aspect, a writing instrument is provided, including a body, a nosecone, and an adapter. The body, nosecone, and adapter each include a generally hollow tubular shape and an inner surface, outer surface, first end, and second end. The first end of the adapter is coupled to the second end of the nosecone. The second end of the adapter is configured to slidably couple to the first end of the body. The writing instrument includes a writing element with a mounting end and a writing end. The mounting end of the writing element is removably coupled to the second end of the body. The adapter includes a track and the track includes a recessed channel in the outer surface of the adapter. The body includes at least one protrusion that extends inward from the inner surface of the body. The protrusion is configured to slidably engage with the track of the adapter.

In another aspect, a retractable writing instrument is provided, including a body and a nosecone. The body and the nosecone each being tubular in shape and slidably coupled to each other. The retractable writing instrument includes writing assembly removably coupled to the body and positioned in an interior lumen formed by the body and the nosecone. The nosecone is selectively movable between an extended position and a writing position. A writing end of the writing assembly extends through an aperture of the nosecone when the nosecone is in the writing position. The nosecone and the body each include a positioning element configured to selectively lock the nosecone in the writing position.

In yet another aspect, a retractable writing instrument is provided, including a body, a nosecone, and an adapter. The body, nosecone, and adapter each including a generally hollow tubular shape and an inner surface, outer surface, first end, and second end. The first end of the adapter is coupled to the second end of the nosecone, and the second end of the adapter is configured to slidably couple to the first end of the body. The retractable writing instrument includes a writing element with a mounting end and a writing end. The mounting end is removably coupled to the second end of the body. The body includes a track, and the track includes a recessed channel in the inner surface of the body. The adapter includes at least one protrusion extending outward from the outer surface of the adapter. The protrusion is configured to slidably engage with the track of the body.

BRIEF DESCRIPTION OF THE DRAWINGS

Referring now to the drawings, which are meant to be exemplary and not limiting, and wherein like elements are numbered alike. The detailed description is set forth with reference to the accompanying drawings illustrating examples of the disclosure, in which use of the same reference numerals indicates similar or identical items. Certain embodiments of the present disclosure may include elements, components, and/or configurations other than those illustrated in the drawings, and some of the elements, components, and/or configurations illustrated in the drawings may not be present in certain embodiments.

DETAILED DESCRIPTION

Figure 1:
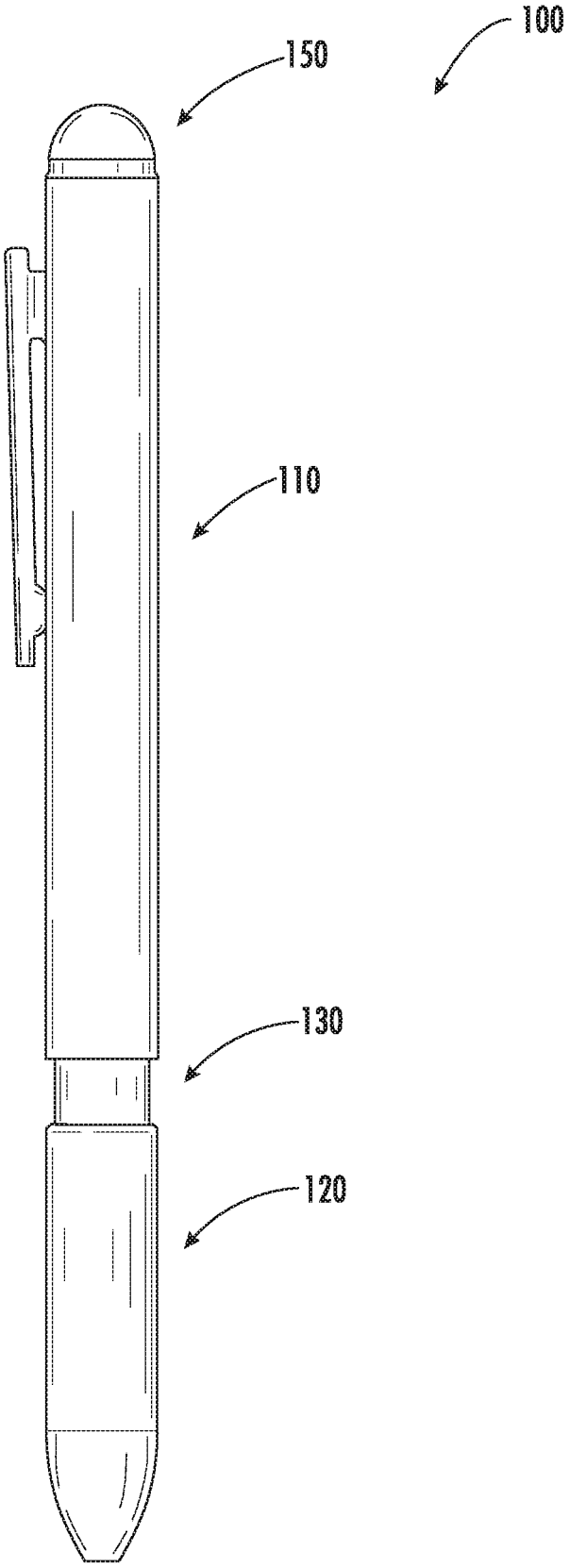
FIG. 1 is a side view of one embodiment of a writing instrument in a storage position.

The twist and snap retractable writing instrument described herein advantageously can accommodate various inks and writing mediums. The present disclosure includes non-limiting embodiments of retractable nosecone writing instruments, referred to generally herein as "writing instruments." The embodiments are described in detail herein to enable one of ordinary skill in the art to practice the twist and snap retractable nosecone writing instruments, although it is to be understood that other embodiments may be utilized and that logical changes may be made without departing from the scope of the disclosure. Reference is made herein to the accompanying drawings illustrating some embodiments of the disclosure, in which use of the same reference numerals indicates similar or identical items. Throughout the disclosure, depending on the context, singular and plural terminology may be used interchangeably.

The meanings of the terms used herein will be apparent to one of ordinary skill in the art or will become apparent to one of ordinary skill in the art upon review of the detailed description when taken in conjunction with the several drawings and the appended claims.

FIG. 1 illustrates a twist and snap retractable nosecone writing instrument in accordance with one or more embodiments of the disclosure. The writing instrument 100 includes a body 110, a nosecone 120, and an adapter 130. As shown in FIG. 1, the writing instrument 100, including the body 110, nosecone 120, and adapter 130, each may generally have a hollow tubular shape. In other embodiments, other cross-sectional geometric shapes may be employed such as triangular, square, or other polygonal shapes, each with an interior cavity that may be cylindrical or be another desirable geometry that still allows for the rotation of the individual elements. Each of the body 110, nosecone 120, and adapter 130 have a first end and an opposed second end. In one embodiment, the first end 132 of the adapter 130 is coupled to the second end 124 of the nosecone 120, and the second end 134 of the adapter 130 is configured to slidably couple to the first end of the body 110. Alternatively, the second end of the adapter 130 may be coupled to the first end 112 of the body 110, and the first end 132 of the adapter may 130 be configured to slidably couple to the second end 124 of the nosecone 120. In other embodiments, individual elements may be combined into a single unitary piece; for example, the adapter 130 and the nosecone 120 may be a single molded piece that is configured to slidably couple to the first end 112 of the body 110, or in the alternative, the adapter 130 may be combined with the body 110 in a single molded piece that is configured to slidably couple to the second end of the nosecone 120. As used herein, the terms "connect," "mount," "couple," and other similar terms are used broadly to refer to any suitable direct or indirect connection mechanism.

Figure 2:
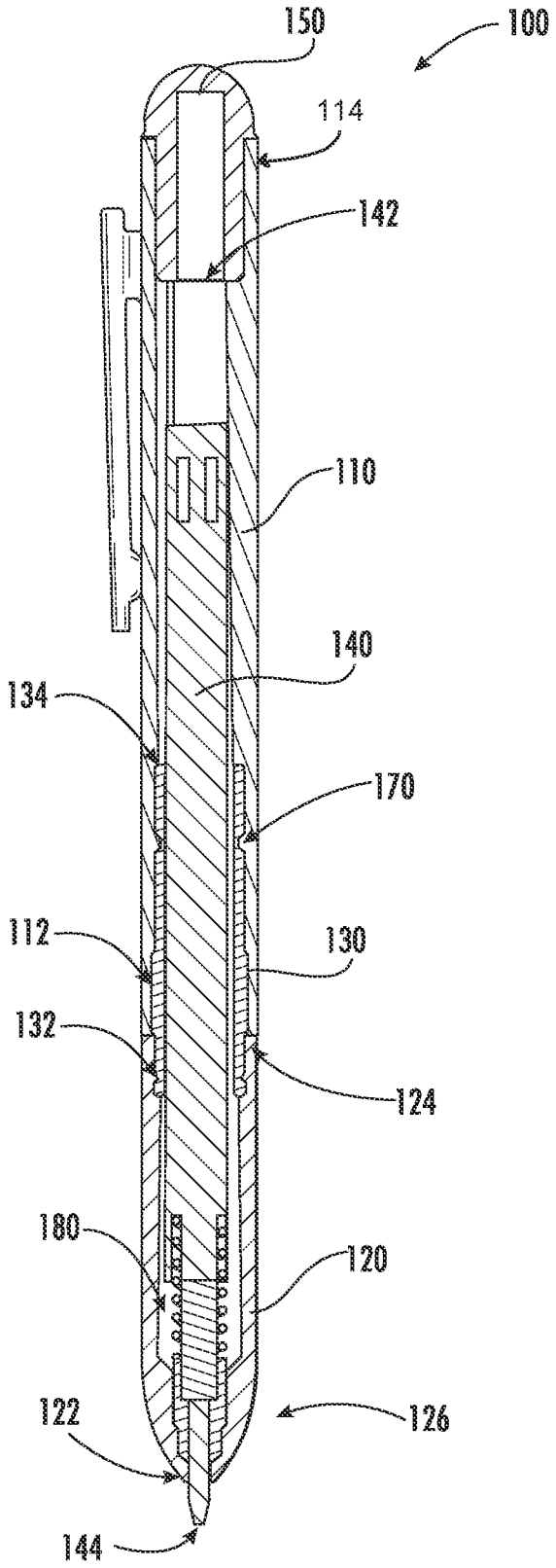
FIG. 2 is a cross-sectional view of the writing instrument of FIG. 1 in a writing position.

FIG. 2 illustrates a sectioned assembly view of the writing instrument 100. As shown in FIG. 2, in one embodiment, the outer diameter of the adapter 130 approximately corresponds to the inner diameter of the nosecone 120 and the body 110. The nosecone 120 and adapter 130 may be joined using several different means depending on the specific embodiment; the mating ends may be press fit, use an adhesive joint, be ultrasonically or thermally welded, may have mating threads, or may have features that snap together. The adapter may have a first adapter end 132 and a second adapter end 134 and be dimensioned to slide and rotate smoothly within the body 110, allowing the adapter 130 to extend from and retract within the body 110 along the longitudinal axis of the writing instrument 100. In some embodiments, the adapter 130 may elastically deform upon assembly with the body 110, so that once assembled, the adapter 130 will not disconnect or de-couple from the body 110.

As shown in FIG. 2, the writing instrument 100 further comprises a writing element 140. The writing element 140 may be a generally tubular shape as shown, or may take another polygonal shape that may or may not match the general geometric shape of the body 110 and nosecone 120. The writing element 140 may have a mounting end 142 and a writing end 144. In some embodiments, the mounting end 142 may be removably coupled to the second end of the body 110. In other embodiments, the body may also contain an end plug 150 coupled to the second end 114 of the body 110, and the mounting end 142 of the writing element 140 may be removably coupled to the end plug 150. The writing element 140 may be coupled to the body 110 or the end plug 150 by use of a press fit, threaded engagement, snap fittings, or other suitable connection method. In one embodiment, the writing element 140 may be a ballpoint pen ink cartridge, comprising an ink reservoir and a ballpoint tip assembly. In some embodiments, the writing element 140 may comprise a thermochromic ink.

The nosecone 120 may have a first nosecone end 122 and a second nosecone end 124. In some embodiments, the first nosecone end 122 transitions to a conical or bullet shaped tip 126. In some embodiments, the tip 126 is integrated into the nosecone 120, which is manufactured or molded as a single component, while in other embodiments, the tip 126 is a separate component that may either be removably attached to the nosecone 120 with, for example, mating threads, or it may be fixed to the nosecone 120 by adhesive, press or snap fit, ultrasonic or thermal welding, or other suitable means.

Figure 3:
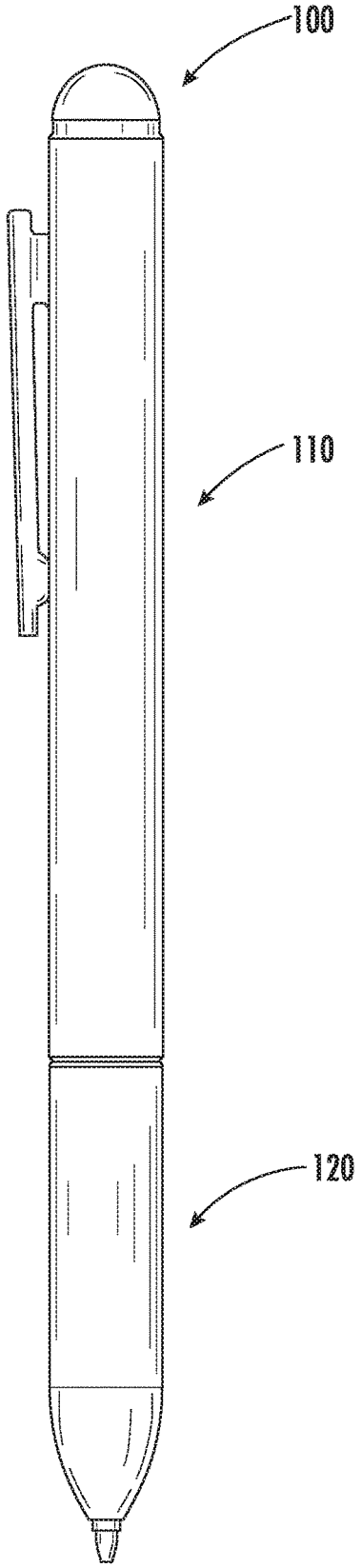
FIG. 3 is a side view of the writing instrument of FIG. 1 in a writing position.

The writing instrument 100 may be selectively moved between an extended storage position, as shown in FIG. 1, and a retracted writing position, as shown in FIGS. 2 and 3. More specifically, when in the storage position, the nosecone 120 and adapter 130 are extended longitudinally away from the body 110 such that they cover completely the writing element 140. When in the writing position, the nosecone 120 and adapter 130 are retracted longitudinally towards the body 110 such that the writing end of the writing element 140 is exposed. As described more fully below, the writing instrument 100 may include a positioning element, configured to selectively lock the nosecone 120 in one of the writing or storage positions, and an extension element 180, configured to bias the nosecone 120 towards the opposite one of the writing or storage positions.

In some embodiments of the writing instrument, as shown in FIGS. 4-10, the adapter 130 includes a track 160, the track 160 may be a recessed channel in the outer surface of the adapter 130, and the body 110 may additionally include a protrusion 170, protruding into the inner lumen of body 110, extending from the inner surface of the body 110, and being configured to slidably engage with the track 160. In other embodiments, the tracks described herein may be disposed 20 on the inner surface of the body 110 and the protrusions described herein may be disposed on the outer surface of the adapter. In some embodiments, the adapter comprises at least two tracks.

Figure 4:
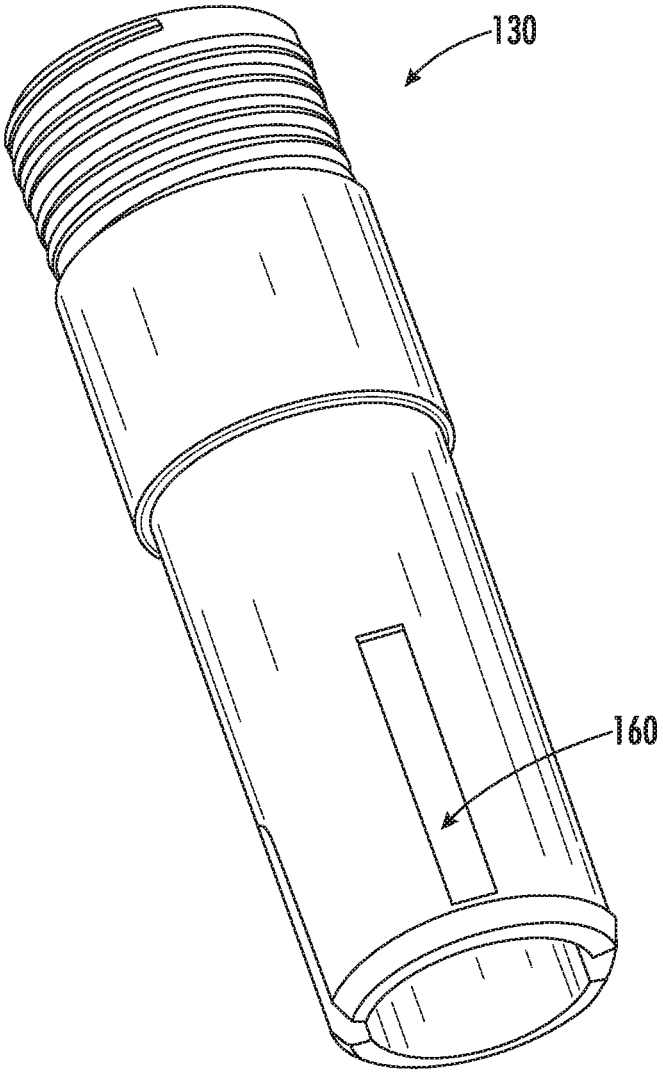
FIG. 4 is a perspective view of one embodiment of an adapter of the writing instrument of FIG. 1.

The sliding engagement of the protrusion 170 within the track 160 guides and restricts the longitudinal and rotational displacement of the adapter 130 and nosecone 120 assembly as they are moved from the writing position to the storage position and from the storage position to the writing position. As shown in FIGS. 4-9, and discussed more below, the tracks (e.g., tracks 160, 260, 360, 460) may have varying paths with respect to the adapter 130. In some embodiments, as shown in FIG. 4, the track 160 may have a square or rectangular cross section, while in other examples, the track may be semicircular, V-shaped, or another desirable geometry. The tracks 160/260/360/460 and the protrusion 170 may be of similar mating (matching) geometries or dissimilar geometries, so long as the tracks 160/260/360/460 is capable of slidably moving over the protrusion 170 when the user applies a force to the nosecone 120. In some embodiments, the protrusion 170 is a square or rectangular protrusion, but it may also be spherical, pyramid shaped, or any other geometry slidable engagement with the track 160/260/360/460.

In some embodiments, as shown in FIGS. 7-10 the adapter may also include a positioning element configured to selectively lock the nosecone 120 in one of the writing or storage positions. In one example, the positioning element is a snap bump 165 configured to protrude outward from a bottom surface of the track 160 towards the outer surface of the adapter 130 and partially resist the slidable movement of the track 160 over the protrusion 170. In one embodiment, the protrusion 170 is configured to selectively lock the nosecone 120 and the adapter 130 in the writing position. When the user applies a force to move the nosecone 120 and adapter 130 to the writing position from the storage position, the user will encounter resistance when the protrusion 170 interferes with the snap bump 165, such that the user may continue to apply force to overcome the interference and snap the writing instrument into the writing position. Because of the interference between the protrusion 170 and the snap bump 165, the writing instrument will stay locked in the writing position until the user applies force to the nosecone in the opposite direction to move the nosecone 120 and adapter 130 back towards the storage position. The snap bump 165 may be disposed within any one of the tracks disclosed herein.

As noted above, the adapter 130 may have a track 160 that forms a channel across at least a portion of the outer surface of the adapter 130. In one example, as shown in FIG. 4, the track 160 may extend longitudinally down at least a portion of the outer surface of the adapter 130. The length and shape of the track guides and restricts the range of motion of the nosecone 120 and adapter 130 with respect to the body 110. When, as shown in FIG. 4, a linear, longitudinal track 160 is used, the nosecone 120 and adapter 130 may only be displaceable in a longitudinal direction and will be prohibited from rotating with respect to the body 110. Accordingly, other, more complex track geometries may be desirable to allow for different movement patterns, changing the activation forces required by the user to move the writing instrument from the writing position to the storage position and the storage position to the writing position.

Figure 5:
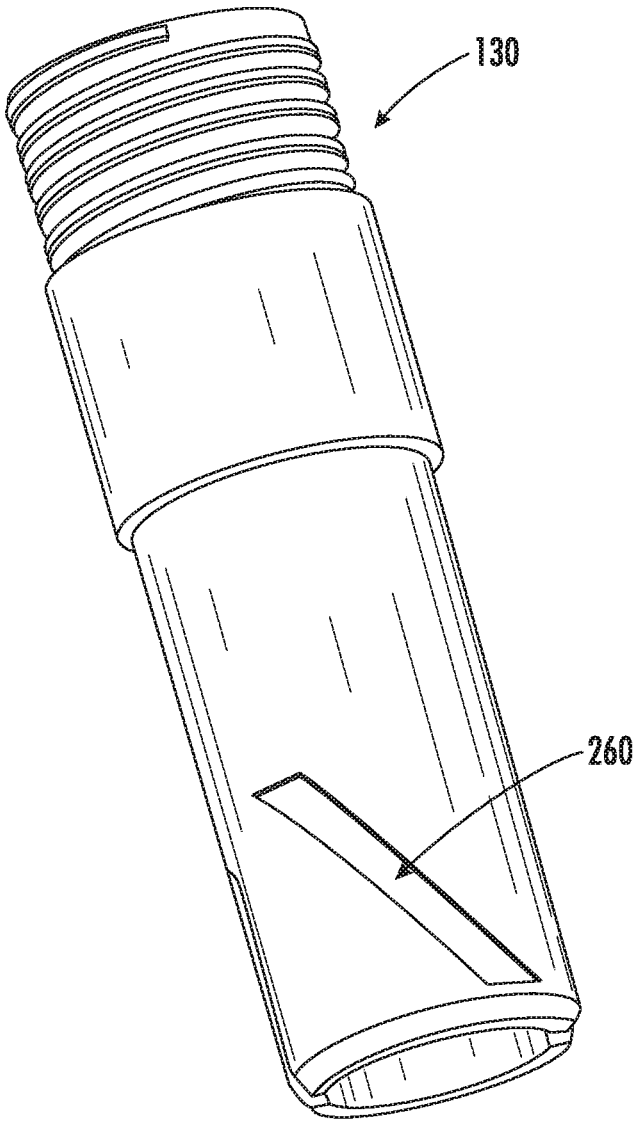
FIG. 5 is a perspective view of one embodiment of an adapter of the writing instrument of FIG. 1.
Figure 6:
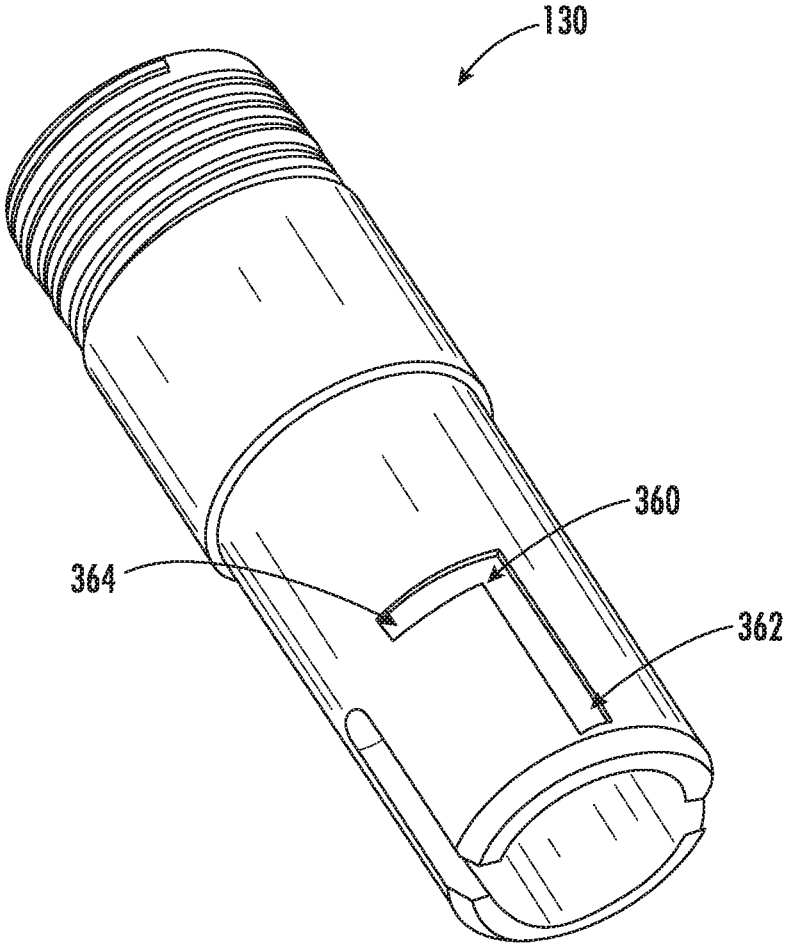
FIG. 6 is a perspective view of one embodiment of an adapter of the writing instrument of FIG. 1.

In one embodiment, as shown in FIG. 5, the track 260 may extend in a helical or coiled path around at least a portion of the outer surface of the adapter 130. In another embodiment, as shown in FIG. 6, the track 360 may create a complex or multi-pathway channel. As shown in FIG. 6, the track 360 may include a first portion 362 and a second portion 364, where the first portion 362 may extend longitudinally down at least a portion of the outer surface of the adapter 130 and where the second portion 364 may extend circumferentially around at least a portion of the outer surface of the adapter 130. As shown, the two sections may be perpendicular, or they may intersect at any desirable angle, so long as the first portion 362 and the second portion 364 are connected together to create a unitary channel that may slide freely over the protrusion 170. As shown, that channel may be generally L-shaped, and allows the track 160 to pass over the protrusion 170 freely.

Figure 7:
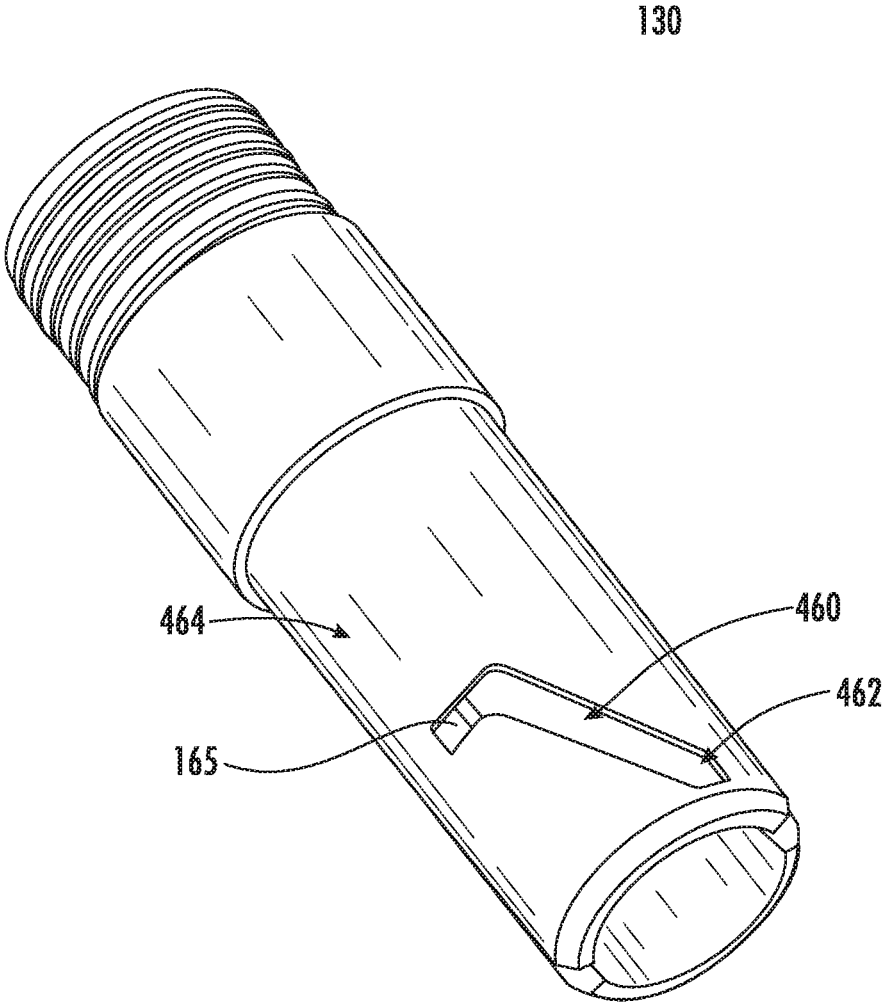
FIG. 7 is a perspective view of one embodiment of an adapter of the writing instrument of FIG. 1.

In some embodiments, two or more of the prior concepts may be combined. In one example, as shown in FIG. 7, the track 460 may include a first portion 462 and a second portion 464, where the first portion 462 may extend in a helical path around at least a portion of the outer surface of the adapter 130, and the second portion 464 may extend circumferentially around at least a portion of the outer surface of the adapter 130, where the first portion 462 and second portion 464 connect together to create a unitary channel that can be generally hockey-stick-shaped as shown. Although certain track geometries are described herein and shown in the referenced drawings, one of ordinary skill in the art will recognize that numerous modifications and alternative embodiments are within the scope of the disclosure.

In some embodiments, as shown in FIG. 2, the writing instrument 100 may also include an extension element 180 configured to bias the nosecone 120 toward the storage position. In other embodiments, the extension element 180 may be configured to bias the nosecone 120 toward the writing position, depending on the particular configuration of the track, protrusion, and positioning element. In some embodiments, as shown in FIG. 2, the extension element 180 is configured to slide over a portion of the writing element 140 and fit inside the inner lumen of the nosecone 120. In some embodiments, the extension element 180 is a compression spring. The compression spring fits over the writing element, pressing against the writing element on one end, and against an inner surface of the nosecone on the other end.

As mentioned above, the adapter 130 may also include a positioning element. As shown in FIG. 7, the positioning element may be a snap bump 165 positioned in the track 160. The snap bump 165 may be any geometry that is configured to protrude into the track and interfere with the protrusion 170 as it passes through the track 460. As the nosecone 120 and adapter 130 are rotated, the track 460 slides over the protrusion 170, when the snap bump 165 interferes with the protrusion 170, the user increases the force applied to the nosecone 120 to overcome the interference and snap the snap bump 165 past the protrusion 170, locking the nosecone, in this case, in the writing position. The interference between the protrusion 170 and the snap bump 165 is great enough to lock the writing instrument in the writing position, and to prevent the extension element 180 from returning the nosecone 120 and adapter 130 to the storage position. To move the writing instrument into the storage position, the user applies force in the opposite direction. Once the snap bump 165 is overcome, the compression spring will bias the nosecone 120 and adapter 130 the rest of the way to the storage position.

Figure 8:
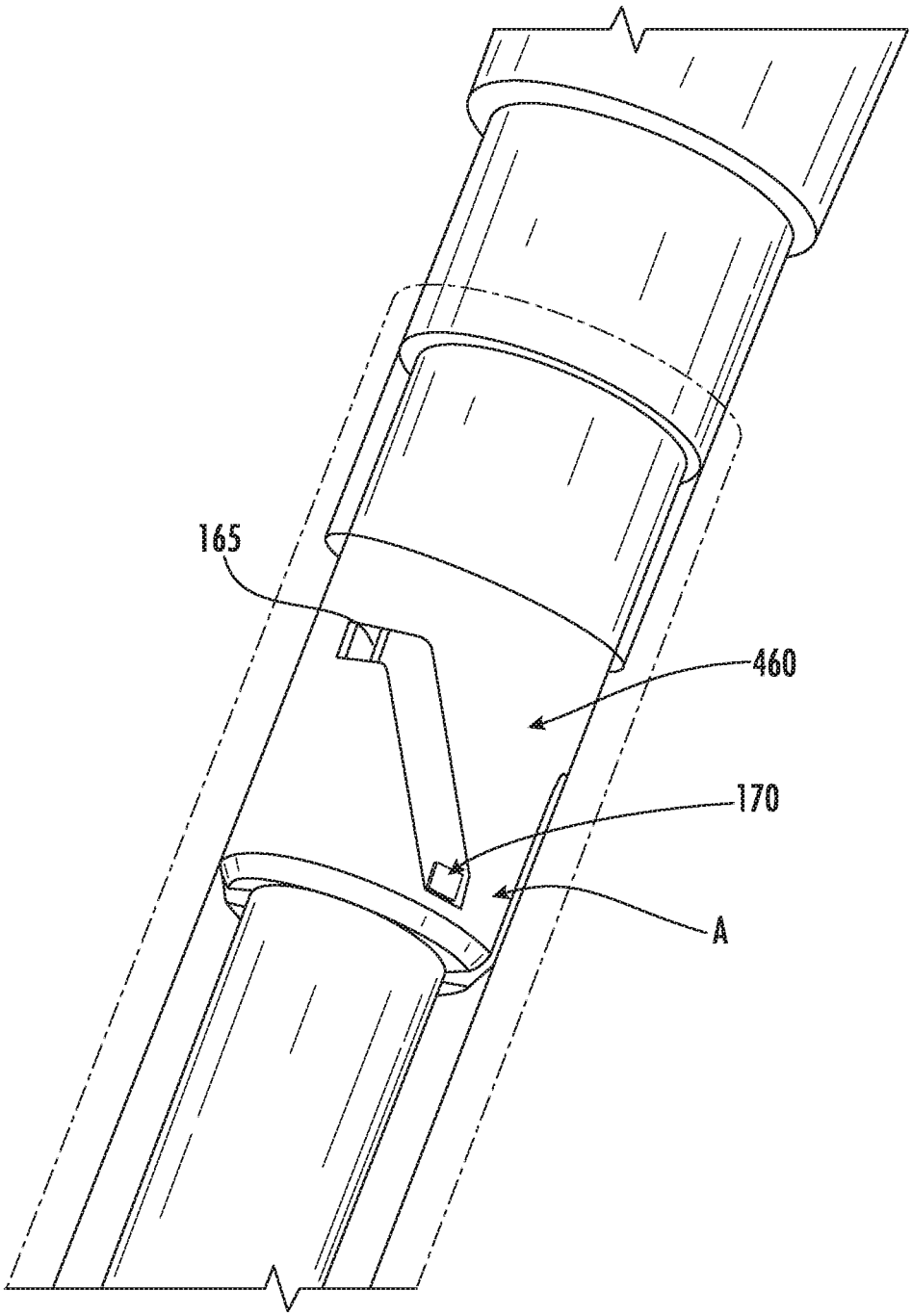
FIG. 8 is a magnified view of one embodiment of the adapter of FIG. 7 within the writing instrument of FIG. 1.
Figure 9:
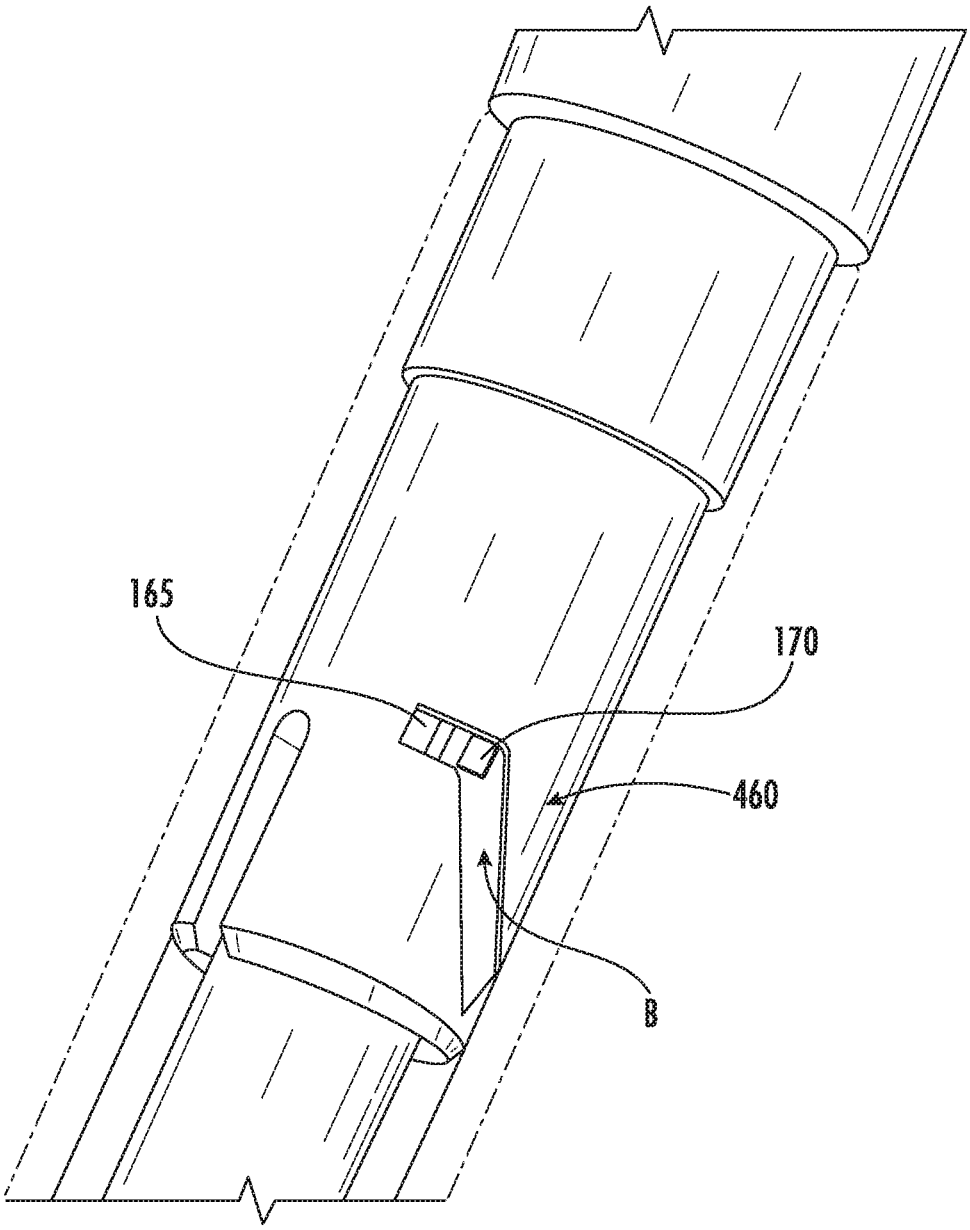
FIG. 9 is a magnified view of one embodiment of an adapter within the writing instrument of FIG. 1.
Figure 10:
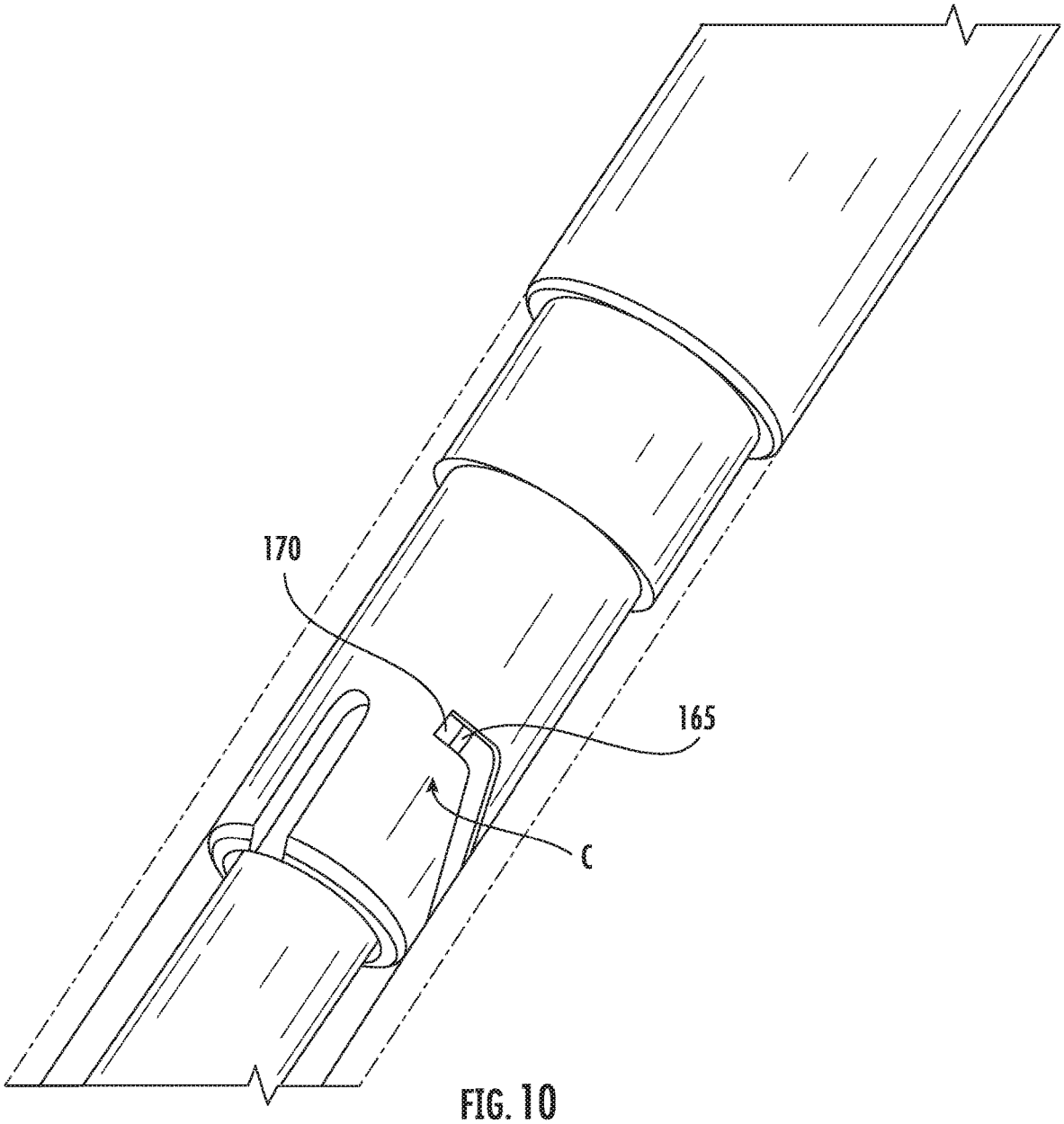
FIG. 10 is a magnified view of one embodiment of an adapter within the writing instrument of FIG. 1.

In one embodiment, as illustrated in FIG. 8, when the writing instrument 100 is in the storage position, the protrusion 170 rests at the body end of the track 460 opposite the snap bump 165, annotated as position A. As the user applies force to the nosecone 120 and adapter 130, the nosecone 120 and adapter 130 rotate, sliding towards the body while rotating. The snap bump 165 approaches the protrusion 170 as shown in FIG. 9 as position B. As the user applies force to overcome the interference between the snap bump 165 and the protrusion 170, the nosecone 120 and adapter 130 rotate from position B, to position C, as shown in FIG. 10, where the nosecone 120 and adapter 130 are locked in the writing position due to the positioning of the snap bump 165 and protrusion 170.

Figure 11:
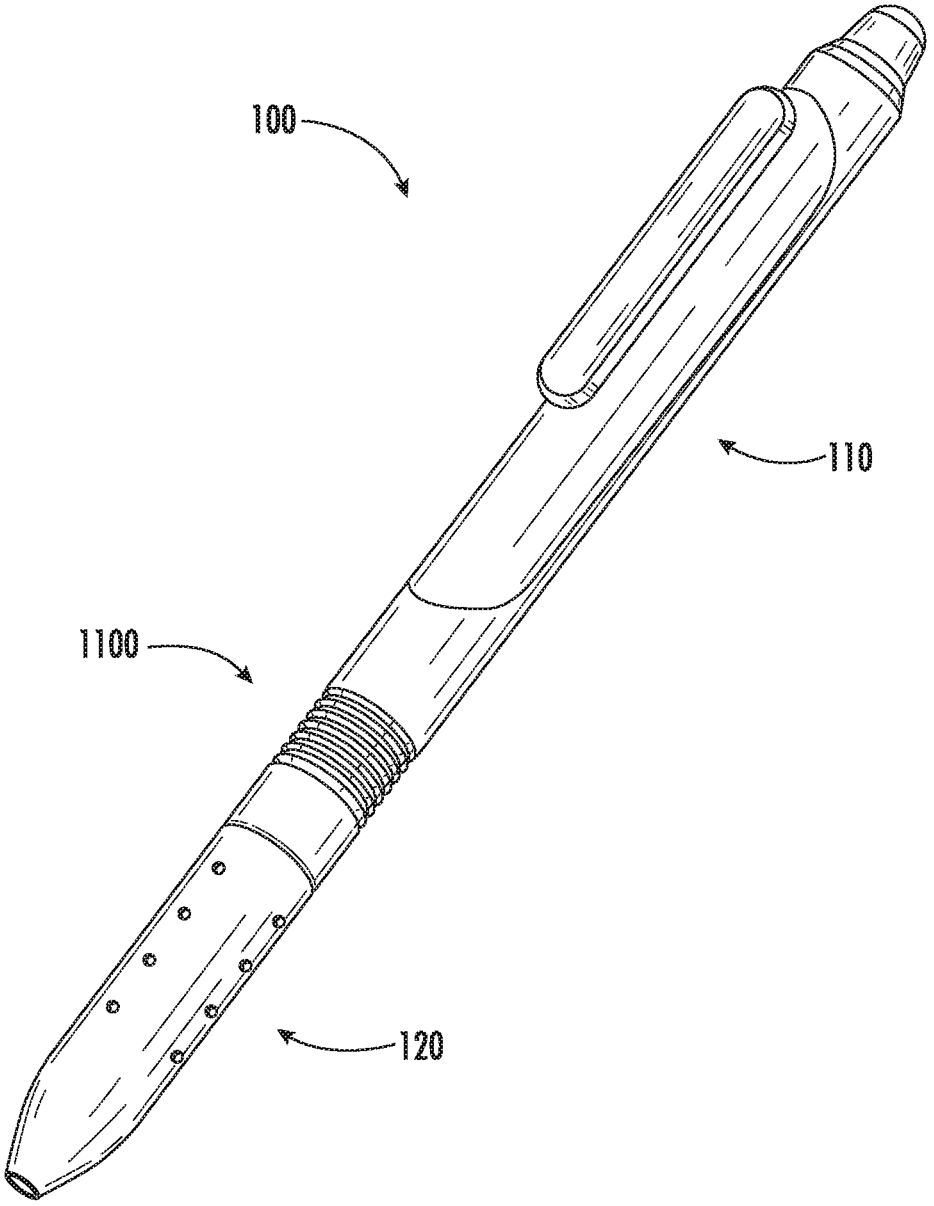
FIG. 11 is a perspective view of one embodiment of a writing instrument.

In certain embodiments, the adapter 130 may be configured to provide a visual indication of the status of the writing instrument 100 by using contrasting color, texture, or other geometric features that may make the configuration readily apparent upon casual visual or tactile inspection. In one embodiment, as shown in FIG. 11, the adapter 130 may be covered by an adapter sleeve 1100. The adapter sleeve may be a flexible or semi-rigid plastic, rubber, or other suitable material that expands and contracts to substantially cover the adapter 130 where it is visible between the body 110 and nosecone 120. In some embodiments, the adapter sleeve 1100 is formed in the shape of a collapsible, cylindrical, bellows as shown in FIG. 11.

Although certain embodiments of the disclosure are described herein and shown in the accompanying drawings, one of ordinary skill in the art will recognize that numerous modifications and alternative embodiments are within the scope of the disclosure. Moreover, although certain embodiments of the disclosure are described herein with respect to specific mechanisms and configurations, it will be appreciated that numerous other mechanisms and configurations are within the scope of the disclosure. Conditional language used herein, such as "can," "could," "might," or "may," unless specifically stated otherwise, or otherwise understood within the context as used, generally is intended to convey that certain embodiments include, while other embodiments do not include, certain features, elements, or functional capabilities. Thus, such conditional language generally is not intended to imply that certain features, elements, or functional capabilities are in any way required for all embodiments.

We claim:

1. A writing instrument, comprising:

a body, a nosecone, and an adapter, wherein the body, nosecone, and adapter each comprise a generally hollow tubular shape and an inner surface, outer surface, first end, and second end, wherein the first end of the adapter is coupled to the second end of the nosecone and the second end of the adapter is configured to slidably couple to the first end of the body, wherein the nosecone is selectively movable between an extended storage position and a retracted writing position;

a writing element having a mounting end and a writing end, the mounting end being removably coupled to the second end of the body; and an extension element being configured to bias the nosecone toward the extended storage position, wherein the adapter further comprises a track, the track comprising a recessed channel in the outer surface of the adapter, wherein the body further comprises at least one protrusion, extending inward from the inner surface of the body and being configured to slidably engage with the track of the adapter, and wherein the adapter is dimensioned to retract within the body along a longitudinal axis of the writing instrument.

2. The writing instrument of claim 1, wherein the adapter further comprises a positioning element configured to selectively lock the nosecone in one of the writing or storage positions.

3. The writing instrument of claim 2, wherein the positioning element is a snap bump, configured to protrude outward from a bottom surface of the track towards the outer surface of the adapter and resist the slidable movement of the track over the body protrusion.

4. The writing instrument of claim 1, wherein a cross section of the track is generally rectangular.

5. The writing instrument of claim 1, wherein the track extends longitudinally along at least a portion of the outer surface of the adapter.

6. The writing instrument of claim 1, wherein the track extends in a helical path around at least a portion of the outer surface of the adapter.

7. The writing instrument of claim 1, wherein the track comprises a first portion and a second portion, the first portion extending longitudinally along at least a portion of the outer surface of the adapter and the second portion extending circumferentially around at least a portion of the outer surface of the adapter, the first portion and the second portion being coupled so as to create a unitary channel that is generally L-shaped.

8. The writing instrument of claim 1, wherein the track comprises a first portion and a second portion, the first portion extends in a helical path around at least a portion of the outer surface of the adapter and the second portion extending circumferentially around at least a portion of the outer surface of the adapter, the first portion and the second portion being coupled so as to create a unitary channel that is generally hockey-stick-shaped.

9. The writing instrument of claim 1, further comprising a plug, the plug being coupled to the second end of the body.

10. The writing instrument of claim 1, wherein the extension element is configured to slide over a portion of the writing element and fit inside the nosecone.

11. The writing instrument of claim 10, wherein the extension element is a compression spring.

12. The writing instrument of claim 1, wherein the adapter is configured to provide a visual indication of a status of the writing instrument.

13. The writing instrument of claim 1, wherein the writing element comprises a thermochromic ink.

14. The writing instrument of claim 1, wherein the adapter comprises at least two tracks.

15. A retractable writing instrument, comprising:

a body and a nosecone, the body and nosecone each being tubular in shape and slidably coupled to each other;

a writing assembly removably coupled to the body and positioned in an interior lumen formed by the body and the nosecone; and a compression spring configured to slide over a portion of the writing element and fit inside the nosecone and bias the nosecone towards an extended storage position, wherein the nosecone is selectively movable between the extended storage position and a retracted writing position, a writing end of the writing assembly extending through an aperture of the nosecone when the nosecone is in the writing position, and wherein the nosecone and the body each comprise a positioning element configured to selectively lock the nosecone in the writing position.

* * * * *